US009150329B2

(12) United States Patent
Watson

(10) Patent No.: US 9,150,329 B2
(45) Date of Patent: Oct. 6, 2015

(54) LOTTERY TICKET DISPENSER

(71) Applicant: Bruce Watson, Atlantic, IA (US)

(72) Inventor: Bruce Watson, Atlantic, IA (US)

(73) Assignee: Owner Revolution Inc., Adair, IA (US)

( * ) Notice: Subject to any disclaimer, the term of this patent is extended or adjusted under 35 U.S.C. 154(b) by 336 days.

(21) Appl. No.: 13/835,647

(22) Filed: Mar. 15, 2013

(65) Prior Publication Data

US 2014/0263373 A1 Sep. 18, 2014

(51) Int. Cl.

| | |
|---|---|
| ***B65D 1/22*** | (2006.01) |
| ***G07B 3/04*** | (2006.01) |
| ***B65D 21/02*** | (2006.01) |
| ***B65D 25/06*** | (2006.01) |
| ***B65D 25/20*** | (2006.01) |
| ***B65D 43/16*** | (2006.01) |
| ***G07C 15/00*** | (2006.01) |

(52) U.S. Cl.

CPC ..... *B65D 21/0209* (2013.01); *B65D 25/06* (2013.01); *B65D 25/205* (2013.01); *B65D 43/163* (2013.01); *G07B 3/04* (2013.01); *G07C 15/005* (2013.01); *B65D 1/22* (2013.01); *B65D 2543/00194* (2013.01); *B65D 2543/00296* (2013.01)

(58) Field of Classification Search

CPC ..... B65D 1/22; B65D 21/0209; B65D 25/06; B65D 25/205; B65D 43/163; B65D 2543/00194; B65D 2543/00296; G07B 3/04; G07C 15/005; G07F 11/06; G07F 11/50; G07F 11/52; G07F 11/54

USPC ..... 206/39–39.3, 425, 449–456, 508–512; 40/312; 220/23.2–23.4; 312/97.1

See application file for complete search history.

(56) References Cited

U.S. PATENT DOCUMENTS

| | | | | |
|---|---|---|---|---|
| 1,571,341 | A * | 2/1926 | Moser | 312/97.1 |
| 1,785,815 | A * | 12/1930 | Kurtz, Jr. | 220/529 |
| 2,842,420 | A * | 7/1958 | Hansen et al. | 312/348.6 |
| 4,004,813 | A * | 1/1977 | Sanden et al. | 206/39.1 |
| 4,778,048 | A * | 10/1988 | Kaspar et al. | 206/449 |
| 5,287,980 | A * | 2/1994 | Saltz | 206/509 |
| 5,399,005 | A * | 3/1995 | Schafer | 206/509 |
| 6,095,624 | A * | 8/2000 | Wilbert | 312/34.7 |
| 7,717,256 | B1 * | 5/2010 | Jensen | 206/39.3 |
| 8,544,648 | B2 * | 10/2013 | Cleveland et al. | 206/508 |
| 8,590,704 | B2 * | 11/2013 | Koenig et al. | 206/508 |
| 8,677,661 | B2 * | 3/2014 | Michels et al. | 40/312 |

* cited by examiner

*Primary Examiner* — Bryon Gehman

(74) *Attorney, Agent, or Firm* — G. Brian Pingel; Camille L. Urban; David M. Breiner

(57) ABSTRACT

Disclosed is a dispensing unit that may include a body having front wall, a first sidewall, a second sidewall, a floor, and a roof. In example embodiments the body may be configured to receive a second floor that may be arranged on the floor and the first and second sidewalls may be configured to receive holders for decorative members.

6 Claims, 7 Drawing Sheets

LOTTERY TICKET DISPENSER

BACKGROUND

1. Field of the Invention

Example embodiments relate to a dispensing unit. In example embodiments, the dispensing unit may be configured to dispense articles such as lottery tickets.

2. Description of the Related Art

In the gaming industry, modular box-like structures are used for displaying and dispensing of lottery tickets. Normally, when a number of such dispensers are located together at a point of sale location, they are arranged in a stacked arrangement with one dispenser being stacked on top of another in a locked relationship. In the conventional art, the box-like structures have a body which may be partitioned into different regions to accommodate different card sizes. This is accomplished by providing various dividers in the body.

SUMMARY

The inventors have discovered that cards stored in conventional lottery ticket dispensers may become disorganized and randomly arranged. Thus, the inventors set out to design a new and inventive lottery dispensing unit having components aimed at better supporting lottery cards to reduce their tendency to randomize. The inventors have also set out to design a new and inventive lottery dispensing unit with improved means of attaching one lottery dispensing unit to another. In addition, the inventors also set out to design and new and inventive lottery dispensing unit whose appearance may be easily modifiable. The inventive concepts disclosed herein, however, are not limited to lottery ticket dispensing units since the inventive concepts may be applied to a variety of units, some of which may dispense lottery tickets and/or other articles, and some of which do not dispense articles. Thus, while example embodiments relate to an article dispensing unit, the inventive concepts are not limited thereto.

In accordance with example embodiments, a dispensing unit that may include a body having front wall, a first sidewall, a second sidewall, a floor, and a roof. In example embodiments the body may be configured to receive a second floor, for example, a sawtooth floor. In example embodiments, the first and second sidewalls may be configured to receive a holder that, in turn, is configured to receive a decorative member so that the dispensing unit is easily modifiable. In example embodiments, the dispensing unit may include attaching structures to allow one dispensing unit to attach to another dispensing unit.

BRIEF DESCRIPTION OF THE DRAWINGS

Example embodiments are described in detail below with reference to the attached drawing figures, wherein.

DETAILED DESCRIPTION

Figure 1:
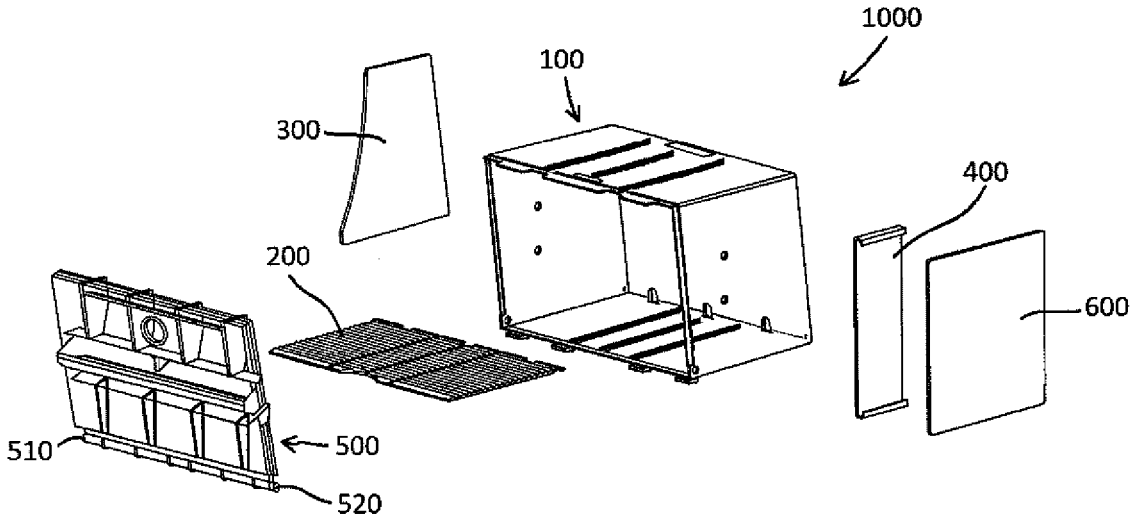
FIG. 1 is an exploded view of a dispensing unit in accordance with example embodiments.

Example embodiments will now be described more fully with reference to the accompanying drawings. Example embodiments are not intended to limit the invention since the invention may be embodied in different forms. Rather, example embodiments are provided so that this disclosure will be thorough and complete, and will fully convey the scope of the invention to those skilled in the art. In the drawings, the sizes of components may be exaggerated for clarity.

In this application, when an element is referred to as being "on," "attached to," "connected to," or "coupled to" another element, the element may be directly on, directly attached to, directly connected to, or directly coupled to the other element or may be on, attached to, connected to, or coupled to any intervening elements that may be present. However, when an element is referred to as being "directly on," "directly attached to," "directly connected to," or "directly coupled to" another element or layer, there are no intervening elements present. In this application, the term "and/or" includes any and all combinations of one or more of the associated listed items.

In this application, the terms first, second, etc. are used to describe various elements and components. However, these terms are only used to distinguish one element and/or component from another element and/or component. Thus, a first element or component, as discussed below, could be termed a second element or component.

In this application, terms, such as "beneath," "below," "lower," "above," "upper," are used to spatially describe one element or feature's relationship to another element or feature as illustrated in the figures. However, in this application, it is understood that the spatially relative terms are intended to encompass different orientations of the structure. For example, if the structure in the figures is turned over, elements described as "below" or "beneath" other elements would then be oriented "above" the other elements or features. Thus, the term "below" is meant to encompass both an orientation of above and below. The structure may be otherwise oriented (rotated 90 degrees or at other orientations) and the spatially relative descriptors used herein interpreted accordingly.

Example Embodiments are illustrated by way of ideal schematic views. However, example embodiments are not intended to be limited by the ideal schematic views since example embodiments may be modified in accordance with manufacturing technologies and/or tolerances.

The subject matter of example embodiments, as disclosed herein, is described with specificity to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other technologies. Generally, example embodiments relate to a dispensing unit. In example embodiments, the dispensing unit may be configured to dispense articles such as lottery tickets.

FIG. 1 is an exploded view of a dispensing unit 1000 in accordance with example embodiments. In example embodiments, the dispensing unit 1000 may be configured to dispense articles, such as lottery tickets. Referring to FIG. 1, the dispensing unit 1000 may be comprised of a body 100 and a door 500. In example embodiments, the door 500 may be rotatably connected to the body 100. For example, the door 500 may include a first pin 510 and a second pin 520 inserted into a first hole 136 and a second hole 156 of the body 100 (see FIG. 2A). This pinned configuration allows the door 500 to swing away from the body 100 so that access to the body 100 may be granted or swing toward the body 100 so that access to the body 100 may be prevented. Though not shown in FIG. 1, it is understood the door 500 may include a lock which engages the body 100 to lock the dispensing unit 1000 thereby preventing access to articles that may be stored therein. In example embodiments, the dispensing unit 1000 may further include a saw-tooth floor 200 which may be inserted into the body 100, one or more dividers 300 that may divide the body 100 into various spaces, and at least one holder 400 configured to connect to the body 100 and hold at least one decorative member 600.

Figure 2A:
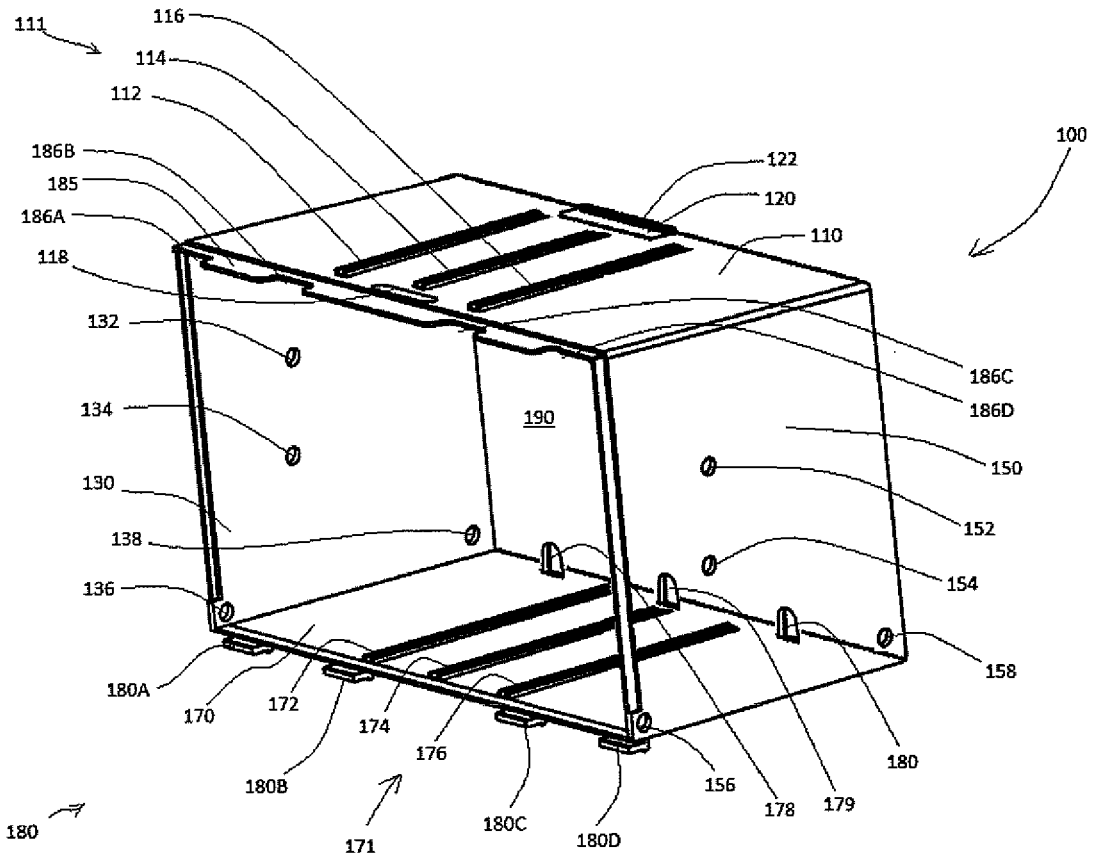
FIG. 2A is a perspective view of a body of the dispensing unit in accordance with example embodiments.

FIG. 2A is a perspective view of the body 100. As shown in FIG. 2A, the body 100 may resemble a box like structure having an open end. For example, as shown in FIG. 2A, the body may be comprised of a plurality of sides, namely, a roof 110, a first side wall 130, a second side wall 150, a floor 170, and a front wall 190. In example embodiments the body 100 may be formed by various processes. For example, the body 100 may be made as one unitary member from an injection molding process and thus may be substantially a single continuous piece. On the other hand the body 100 may be constructed by independently forming the roof 110, the first side wall 130, the second side wall 150, the floor 170, and the front wall 190 and then joining them together with a joining member such as an epoxy or conventional screws. As another example, each of the roof 110, the first side wall 130, the second side wall 150, the floor 170, and the front wall 190 may be formed separately and then fastened together by various joints, such as dove joints, which are well known in the art.

In example embodiments the roof 100 may resemble a substantially rectangular plate. This aspect of example embodiments, however, is not meant to limit the invention. For example, in example embodiments, the roof 100 may have another shape such as, but not limited to, a triangular shape, a square shape, a polygonal shape, a circular shape, or an elliptical shape.

Figure 2B:
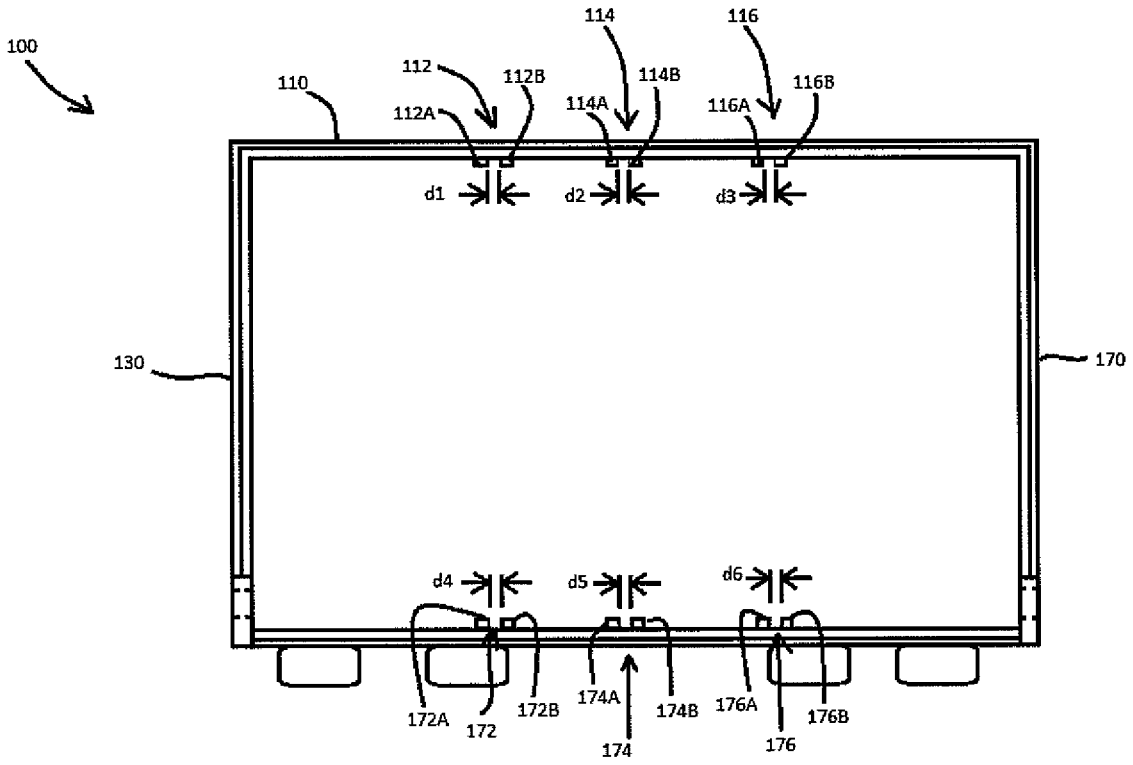
FIG. 2B is a section view of the body in accordance with example embodiments.

In example embodiments, the roof 100 may include a first plurality of rails 111 formed on a lower surface thereof. For example, as shown in FIGS. 2A and 2B, the first plurality of rails 111 may include a first rail 112, a second rail 114, and a third rail 116. Although the first plurality of rails 111 is illustrated as being comprised of three rails, example embodiments are not limited thereto as the first plurality of rails 111 may include more than three rails or less than three rails.

As shown in the figures, the rails of the first plurality of rails 111 may be substantially parallel with one another and may be parallel with the first side wall 130 and the second side wall 150. Example embodiments, however, are not intended to be limited by these features since the rails of the first plurality of rails 111 are not required to be parallel with one another and/or may not be parallel with either the first sidewall 130 or the second side wall 150.

In example embodiments, each of the rails of the first plurality of rails 111 may be comprised of a pair of longitudinal protrusions that extend from the lower surface of the roof 110. For example, as shown in at least FIGS. 2A and 2B, the first rail 112 may be comprised of a first protrusion 112A and a second protrusion 112B, the second rail 114 may be comprised of a third protrusion 114A and a fourth protrusion 114B, and the third rail 116 may be comprised of a fifth protrusion 116A and sixth protrusion 116B.

In example embodiments, distances separating the pairs of protrusions forming first plurality of rails 111 may be about the same as a thickness of the divider 300. For example, a first distance d1 separating the first protrusion 112A from the second protrusion 112B, may be about the same as a second distance d2 separating the third protrusion 114A from the fourth protrusion 114B, which may be about the same as a third distance d3 separating the fifth protrusion 116A from the sixth protrusion 116B, which may be about the same as, or slightly larger than, a thickness t of the divider 300. Thus, in example embodiments, the divider 300 may easily be accommodated within any one of the rails of the first plurality of rails 111.

Although example embodiments describe the first plurality of rails 111 as being comprised of a pair of protrusions extending from the bottom surface of the roof 110, example embodiments are not limited thereto. For example, rather than forming the first plurality of rails 111 as protrusions extending from the bottom surface of the roof 110, elongated C-shaped or U-shaped members may be provided on the bottom of the roof 110.

In example embodiments, the roof 100 may also include an aperture 118 and a depression 120. The aperture 118 may, for example, resemble a slotted hole which may be configured to receive a portion of the lock (not shown) to allow the dispensing unit 1000 to be in a locked position. The depression 120 may resemble an indentation in the roof 110 over which a connecting bar 122 may pass. In example embodiments, a connector of a second dispensing unit 1000* may use the connecting bar 122 as an attachment structure (to be explained shortly).

In example embodiments the first side wall 130 may resemble a substantially rectangular plate. This aspect of example embodiments, however, is not meant to limit the invention. For example, in example embodiments, the first side wall 130 may have another shape such as, but not limited to, a triangular shape, a square shape, a polygonal shape, or a circular shape. In example embodiments, the first side wall 130 may be arranged near a first side of the roof 110 and may be oriented substantially perpendicular to the roof 110. Again, this aspect of example embodiments is not intended to limit the invention since the first side wall 130 may not be substantially perpendicular to the roof 110.

In example embodiments, the first side wall 130 may include a plurality of apertures. For example, in example embodiments, the first side wall 130 may include a first hole 132 and a second hole 134 configured to allow a first peg 430 and a second peg 432 of the holder 400 to be inserted therein (see FIG. 4). Although the first and second holes 132 and 134 are illustrated as being substantially circular, the holes may have another shape such as a stepped shape, a slotted shape, or a polygon shape.

In example embodiments the first side wall 130 may include a third hole 136 (also referred to as the body's first hole) configured to receive a pivot pin of the door 500. In example embodiments, the first side wall 130 may further include a fourth hole 138 configured to receive a first post 270 of the a saw-tooth floor 200 (see FIG. 3). Variations of the aforementioned features are considered to fall within the scope of this invention. For example, while the figures illustrate the first wall 130 as including a fourth hole 138 configured to receive a first post 270 of the saw-tooth floor 200, the fourth hole 138 may be replaced with a post (a body post) and the first post 270 may be replaced with a cavity or hole into which the post of the body post may be inserted.

In example embodiments the second side wall 150 may also resemble a substantially rectangular plate. This aspect of example embodiments, however, is not meant to limit the invention. For example, in example embodiments, the second side wall 150 may have another shape such as, but not limited to, a triangular shape, a square shape, a polygonal shape, or a circular shape. In example embodiments, the second side wall 150 may be arranged near a second side of the roof 110 and may be oriented substantially perpendicular to the roof 110. Again, this aspect of example embodiments is not intended to limit the invention since the second side wall 150 may not be substantially perpendicular to the roof 110.

In example embodiments, the second side wall 150 may also include a plurality of apertures. For example, in example embodiments, the second side wall 150 may include a fifth hole 152 and a sixth hole 154 configured so that a first peg 430 and a second peg 432 of another holder 400 may be inserted therein. Although the fifth and sixth holes 152 and 154 are illustrated as being substantially circular, the holes may have another shape such as a stepped shape, a slotted shape, or a polygon shape. In example embodiments the second side wall 150 may also include a seventh hole 156 (also referred to as the body's second hole) configured to receive a pivot pin 520 of the door 500. In example embodiments, the second side wall 150 may further include an eighth hole 158 configured to receive a second post 272 of the a saw-tooth floor 200.

In example embodiments the floor 170 may resemble a substantially rectangular plate that is substantially parallel to the roof 110. This aspect of example embodiments, however, is not meant to limit the invention. For example, in example embodiments, the floor 170 may have another shape such as, but not limited to, a triangular shape, a square shape, a polygonal shape, or a circular shape. As another example, the floor 170 may be inclined with respect to the roof 120 rather than parallel with it.

In example embodiments, the floor 170 may include a second plurality of rails 171 formed on an upper surface thereof. For example, as shown in FIGS. 2A and 2B, the second plurality of rails 171 may include a fourth rail 172, a fifth rail 174, and a sixth rail 176. Although the second plurality of rails 171 illustrated in FIGS. 2A and 2B are comprised of three rails, example embodiments are not limited thereto as the second plurality of rails 171 may include more or less than three rails.

As shown in the figures, the second plurality of rails 171 may be substantially parallel with one another and may be parallel with the first side wall 130 and the second side wall 150. Example embodiments, however, are not intended to be limited by these features since the rails of the second plurality of rails 171 are not required to be parallel with one another and/or may not be parallel with either the first sidewall 130 or the second side wall 150.

In example embodiments, each of the rails of the second plurality of rails 171 may be comprised of a pair of longitudinal protrusions that extend from an upper surface of the floor 170. For example, the fourth rail 172 may be comprised of a seventh protrusion 172A and an eighth protrusion 172B, the fifth rail 174 may be comprised of a ninth protrusion 174A and a tenth protrusion 174B, and the sixth rail 176 may be comprised of an eleventh protrusion 176A and a twelfth protrusion 176B.

In example embodiments, distances separating the pairs of protrusions forming the second plurality of rails 171 may be about the same as the thickness t of the divider 300. For example, a fourth distance d4 separating the seventh protrusion 172A from the eighth protrusion 172B, may be about the same as a fifth distance d5 separating the ninth protrusion 174A from the tenth protrusion 174B, which may be about the same as a sixth distance d6 separating the eleventh protrusion 176A from the twelfth protrusion 176B, which may be about the same as, or slightly larger than, the thickness t of the divider 300. Thus, in example embodiments, the divider 300 may easily be accommodated within any one of the rails of the second plurality of rails 171.

Although example embodiments describe the rails of the second plurality of rails 171 as being comprised of a pair of protrusions extending from the top surface of the floor 170, example embodiments are not limited thereto. For example, rather than forming the rails as protrusions extending from the top surface of the floor 170, elongated C-shaped or U-shaped members may be provided on the top surface of the floor 170.

When viewed from above, the first plurality of rails 111 may overlap the second plurality of rails 171. For example, when viewed from above, the first, second, and third rails 112, 114, and 116 of the roof 110 may be substantially over the fourth, fifth, and sixth rails 172, 174, and 176 of the floor 170. In this way, a divider 300 sliding into the first rail 112 may also slide into the fourth rail 172. Similarly, a divider 300 sliding into the second rail 114 may also slide into the fifth rail 174. Similar yet, a divider 300 sliding into the third rail 116 may also slide into the sixth rail 176. Accordingly, a divider 300 may be arranged in more than one location within the body 100 or a plurality of dividers 300 may simultaneously be arranged and supported in the body 100 to divide a space of the body 100 into different regions.

In example embodiments, the floor 170 may further include a plurality of article holders. For example, the floor 170 may include first article holder 178, a second article holder 179, and a third article holder 180. In example embodiments, the first, second, and third article holders 178, 179, and 180 may resemble protrusions protruding up from the floor 170. In example embodiments, the article holders 178, 179, and 180 may be configured to hold or support an article, such as a lottery card, in a vertical orientation. Thus, in the event the front wall 190 is comprised of a transparent or translucent material, a user may be able to observe the article supported by the article holders 178, 179, and 180 by looking through the front wall 190. Although the figures illustrate the floor as including three article holders, example embodiments are not limited thereto as their may be more or less than three article holders.

In example embodiments the front wall 190 may resemble a substantially rectangular plate. This aspect of example embodiments, however, is not meant to limit the invention. For example, in example embodiments, the front wall 190 may have another shape such as, but not limited to, a triangular shape, a square shape, a polygonal shape, or a circular shape.

In example embodiments, the front wall 190 may include a plurality of apertures corresponding to the plurality of article holders. Example embodiments, however, are not limited thereto as the front wall 190 may be formed without apertures. In example embodiments the front wall 190 may be substantially perpendicular to the roof 110, the first side wall 130, the second side wall 150 and the floor 170. In addition, the front wall 190 may be formed from a transparent or translucent material. Thus, an observer may be able to view the contents of the dispensing unit 1000 by looking through the front wall 190. In example embodiments, the front wall 190 may further include a depression in common with the depression 120 of the roof, though example embodiments are not limited thereto.

Figure 3:
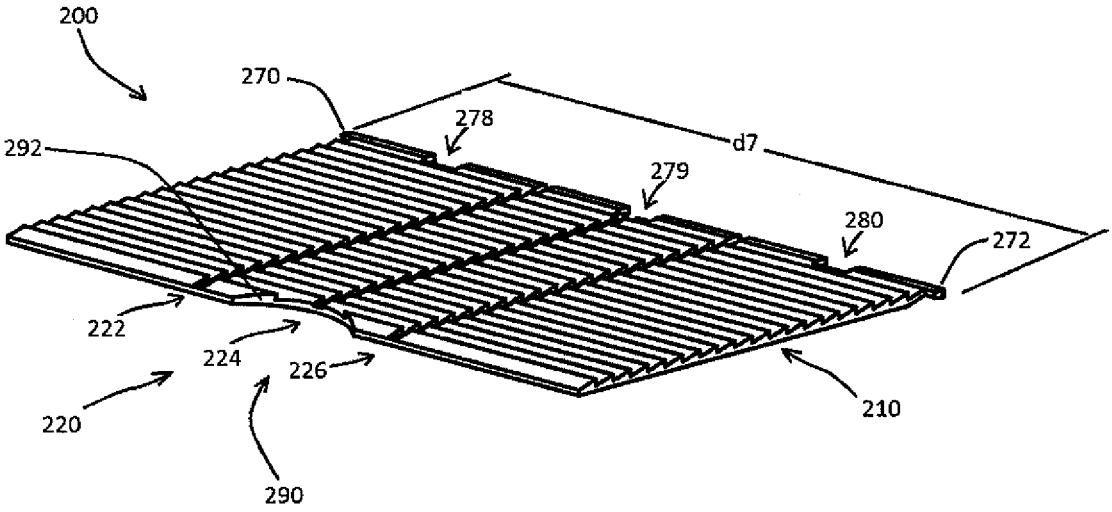
FIG. 3 is a view of a sawtooth floor in accordance with example embodiments.

Referring to FIGS. 1 and 3, as indicated above, the dispensing unit 1000 may include a sawtooth floor 200. The sawtooth floor 200, for example, may be a removable floor configured to connect to the body 100. In example embodiments, the sawtooth floor 200 may resemble a substantially rectangular plate having substantially the same dimensions as the floor 170. Thus, in example embodiments, the sawtooth floor 200 may substantially cover the floor 170. However, example embodiments are not limited thereto as the sawtooth floor 200 may be substantially smaller than the floor 170 such that the floor 170 is only partially covered by the sawtooth floor 200.

In example embodiments, the sawtooth floor 200 may include a first protrusion 270 (for example, a first post) that may be configured to insert into the fourth aperture 138 of the first wall 130 and a second protrusion 272 (for example, a second post) configured to insert into the eighth aperture 158 arranged in the second wall 150. In example embodiments, a distance d7 separating ends of the first and second protrusions 270 and 272 may be slightly larger than a distance separating inner surfaces of the first wall 130 and the second wall 150. However, because the sawtooth floor 200 may be made of a resilient material, for example, a plastic or acrylic, the sawtooth floor 200 may be slightly deformed to allow the first protrusion 270 to insert into the fourth aperture 138 of the first wall 130 and the second protrusion 272 to insert into the eighth aperture 158 arranged in the second wall 150.

In example embodiments, the sawtooth floor 200 may include a plurality of sawtooth members 210. In example embodiments, a plurality of channels 220 may be formed in the plurality of sawtooth members 210. For example, as shown in FIG. 3, the sawtooth floor 200 may include a first channel 222, a second channel 224, and a third channel 226. The number of channels, however, is not meant to limit the invention since the sawtooth floor may have more or less than three channels. In example embodiments, the plurality of channels 220 may be arranged on the sawtooth floor 200 such that when the sawtooth floor 200 is inserted into the body 100, the plurality of channels 220 and the first plurality of rails 111 on the roof 110 are substantially aligned with one another when viewed through the roof 110. Thus, when the sawtooth floor 200 is inserted into the body 100, a divider 300 may be simultaneously inserted into and supported by the first plurality of rails 111 and the plurality of channels 220. For example, a divider may be simultaneously inserted into and supported by both the first channel 222 and the first rail 112. Similarly, another divider 300 may be simultaneously inserted into and supported by both the second channel 224 and the second rail 114. Similar yet, a divider 300 may be simultaneously inserted into and supported by both the third channel 226 and the third rail 116. As is apparent from the above description, the plurality of channels should have a width large enough to accommodate a divider 300. Thus, a width defining the first channel 222, a width defining the second channel 224, and a width defining the third channel 226 may be about the same as, or slightly larger than the thickness t of the divider 300.

In example embodiments, the sawtooth floor 200 may include a plurality of notches to accommodate the plurality of article holders. For example, the saw tooth member may include a first notch 278, a second notch 279, and a third notch 280 which may accommodate the first article holder 178, the second article holder 179, and the third article holder 180. In addition, a grip portion 290 of the sawtooth floor 200 may be formed so that the sawtooth floor 200 may be easily manipulated by a user. In example embodiments, the grip portion 290 is formed by removing a semicircular area of the sawtooth floor and chamfering the semicircular edge to create a lip 292. Thus, the sawtooth floor 200 is easily liftable by engaging the lip 292 of the grip portion 290. Although example embodiments show the grip portion 290 as resembling a semicircular area, the shape of the illustrated grip portion 290 is not intended to limit example embodiments. For example, rather than removing a semicircular area, a square or rectangular area may be removed to form a square or rectangular grip portion 290.

Figure 4:
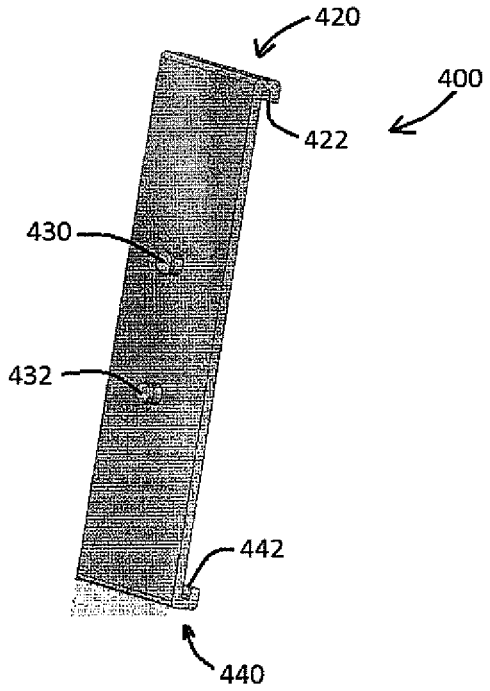
FIG. 4 is a view of a holder in accordance with example embodiments.

FIG. 4 is a perspective view of the holder 400. In example embodiments, the holder 400 may resemble a substantially flat plate with a first protrusion 430 and a second protrusion 432 protruding therefrom. In example embodiments, the first protrusion 430 and the second protrusion 432 may be insertable into the first aperture 132 and the second aperture 134 of the first wall 130. Thus, a spacing separating the first and second apertures 132 and 134 may be substantially the same as a spacing separating the first and second protrusions 430 and 432. Similarly, the first protrusion 430 and the second protrusion 432 may be insertable into the fifth aperture 152 and the sixth aperture 154 arranged in the second wall 150. Thus, a spacing separating the fifth and sixth apertures 152 and 154 may be substantially the same as a spacing separating the first and second protrusions 430 and 432.

In example embodiments, ends of the holder 400 may include channels into which a decorative member 600 may be inserted. For example, as shown in FIG. 4, the holder 400 may have a first channel 422 formed at a first end 420 of the holder and a second channel 442 formed in the second end 440 of the holder 400. In example embodiments, the channels 422 and 442 may be configured so that the decorative member 600 may slide therein.

In example embodiments, two holders may be provided to attach to the body 100. The first and second holders may be substantially identical to the earlier described holder 400. Thus, the first holder may be attached to the first sidewall 130 of the body 100 by inserting a pair of protrusions corresponding to protrusions 430 and 432 into the first and second apertures 132 and 134. Similarly, because the second sidewall 150 may be substantially similar to the first sidewall 130, the second holder may be attached to the second sidewall 150 of the body 100 by inserting a pair of protrusions corresponding to protrusions 420 and 432 into the fifth and sixth apertures 152 and 154.

In example embodiments, the decorative member 600 may resemble a substantially flat plate configured to cover a side of the body 100. The decorative member 600, for example, may be made of a translucent material, such as glass or plastic, or may be made of a solid material that cannot be seen through. In example embodiments, two decorative members 600 may be attached to sides of the body 100 via two holders 400 that may be attached to the first side 130 and the second side 150 as described above.

Figure 5:
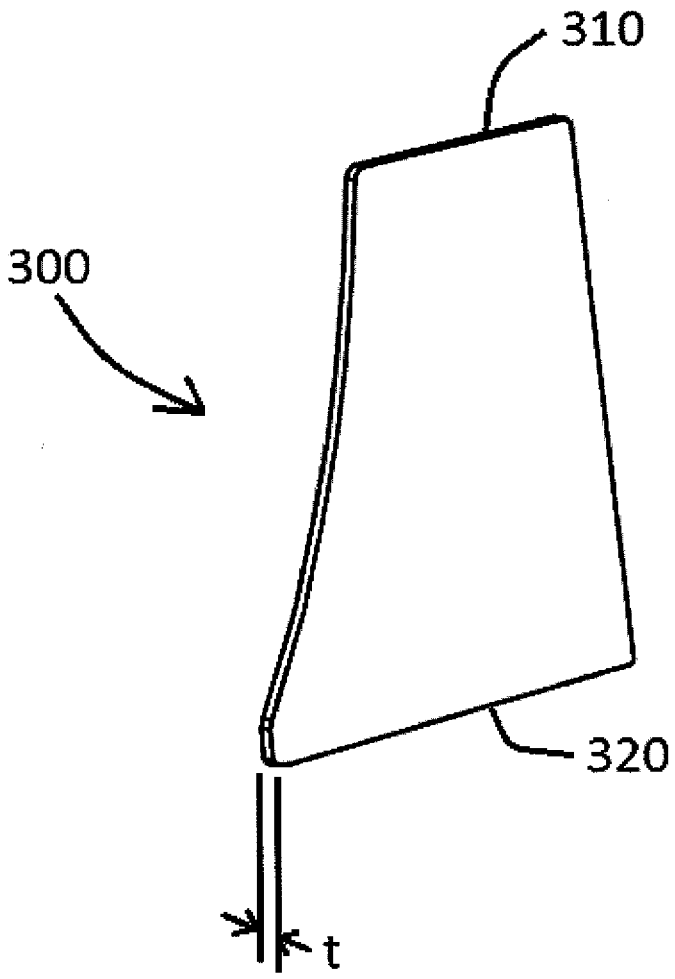
FIG. 5 is view of a divider in accordance with example embodiments.

FIG. 5 is a view of a divider 300 in accordance with example embodiments. In example embodiments, the divider 300 is illustrated as a substantially plate shaped member having a substantially constant thickness t. These aspects of example embodiments are not intended to limit example embodiments as the divider may have a tapering thickness or a stepped thickness. For example, ends of the divider 300 may be configured to insert into the first plurality of the rails 111 and the plurality of channels 220 while a middle portion of the divider 300 may be thicker than the ends.

In example embodiments, a first end 310 of the divider 300 may be configured to insert into the first plurality of rails 111 and a second end 320 of the divider 300 is configured to insert into the plurality of channels 220 when the sawtooth floor 200 is inserted into the body 100. For example the first end 310 of the divider 300 may be inserted into the first rail 112 while the second end 320 of the divider 300 is inserted into the first channel 222. Similarly, the first end 310 of the divider 300 may be inserted into the second rail 114 while the second end 320 of the divider 300 is inserted into the second channel 224. Similarly, the first end 310 of the divider 300 may be inserted into the third rail 116 while the second end 320 of the divider 300 is inserted into the third channel 226.

In example embodiments, multiple dividers 300 may be provided to create or define multiple spaces in body 110. For example, the space in the body 110 may be divided into two substantially equal spaces by inserting a single divider 300 into the second rail 114 and the second groove 224 provided the second floor 200 has been inserted into the body 100. Similarly, the space in the body 110 may be divided into three substantially equally regions by inserting a first divider 300 into the first rail and the first channel 222 and a second divider 300 into the third rail 116 and the third channel 226.

Referring back to FIG. 2A, it is observed that the body 100 may further include a plurality of feet 180, a receiving surface 185 (an example of a lip) with a plurality of receiving notches 186, and a connecting member 187. For example, the body 100 may include a first foot 180A, a second foot 180B, a third foot 180C, and a fourth foot 180D. The first plurality of receiving notches 186 may include a first receiving notch 186A, a second receiving notch 186B, a third receiving notch 186C, and a fourth receiving notch 186D. The connecting member 187 may be arranged at a front of the body 100 (near the front wall 190) and may resemble a J-shaped member, such as a hook. In example embodiments, the connecting member 187 and the plurality of feet 180 may have substantially the same height so that floor 170 is relatively level when the body 100 is placed on a relatively flat level surface.

In example embodiments, the connecting member 187 of the dispensing unit 1000 may be inserted into the depression 120* of the roof 110* of another dispensing unit 1000* and the feet 180 of a first dispensing unit 1000 may be inserted into the plurality of receiving notches 186* of a second dispensing unit 1000*(which may be identical to the dispensing unit 1000). Thus, the feet 180, the receiving notches 186, and the connecting member 187 help secure one dispensing unit to another dispensing unit.

Although example embodiments illustrate the plurality of feet 180 as including four feet and the plurality of receiving notches 186 as including four notches, example embodiments are not limited thereto as there may be more or less than four feet and more or less than four receiving notches.

In example embodiments, the receiving notches 186 and the feet 180 may be substantially aligned with another. For example, when viewed from above, the first foot 180A may aligned with the first receiving notch 186A, the second foot 180B may aligned with the second receiving notch 186B, the third foot 180C may aligned with the third receiving notch 186C, and the fourth foot 180D may be aligned with the fourth receiving notch 186D. Furthermore, the area defining the plurality of receiving notches 186 may large enough to accommodate the plurality of feet 180 so that the feet 180 of a first dispensing unit may be inserted into the receiving notches of another dispensing unit. Thus, for example, widths of the plurality of receiving notches 186 may be substantially the same as, or larger than, widths of the plurality of feet 180.

Figure 6A:
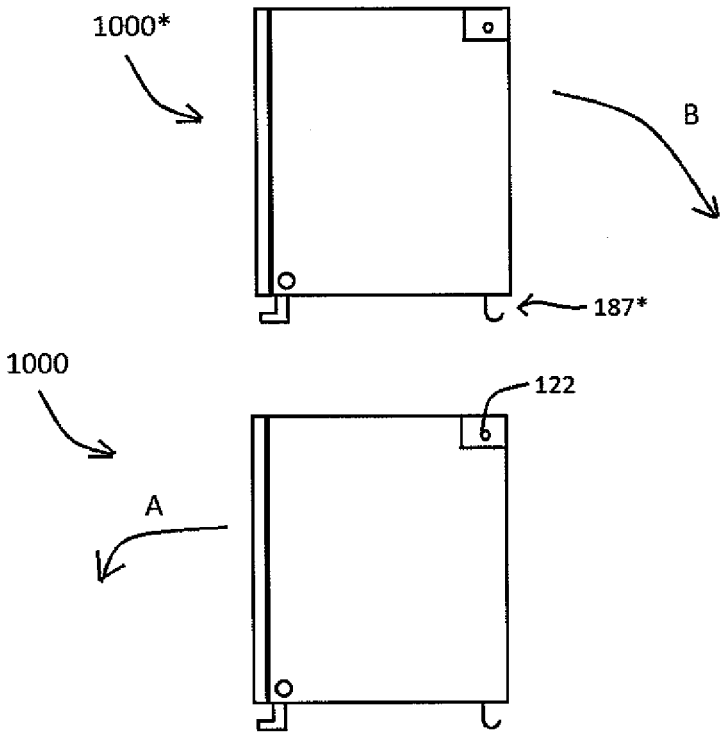
FIGS. 6A-6E are views showing a stacking of dispensing units in accordance with example embodiments.
Figure 6B:
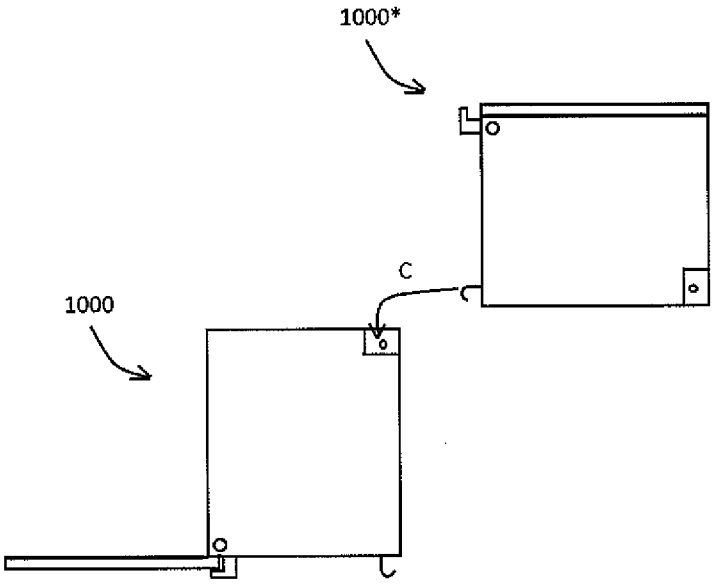
Figure 6C:
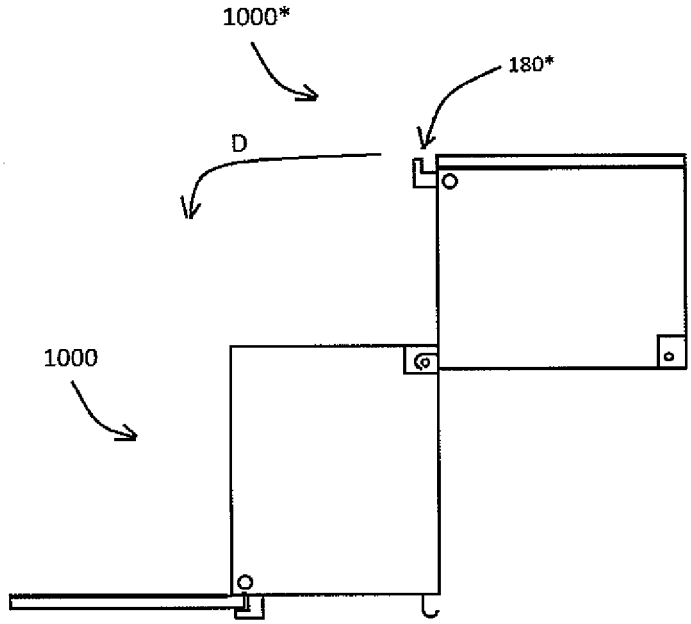
Figure 6D:
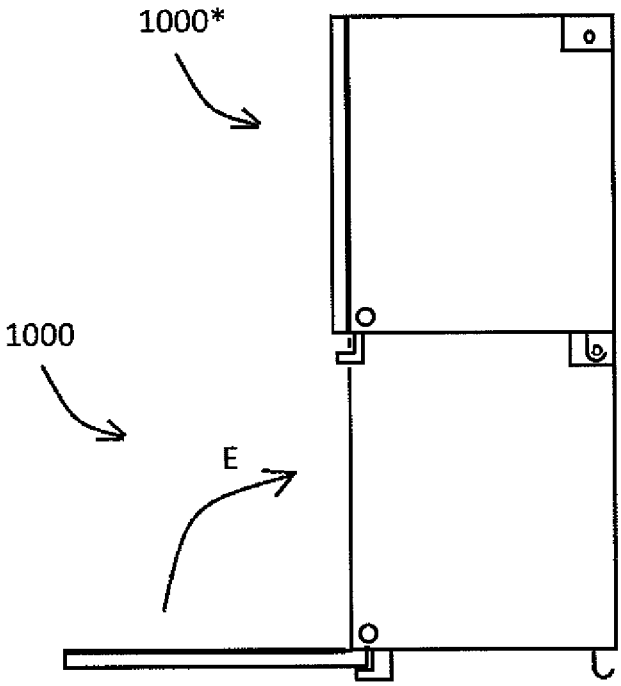
Figure 6E:
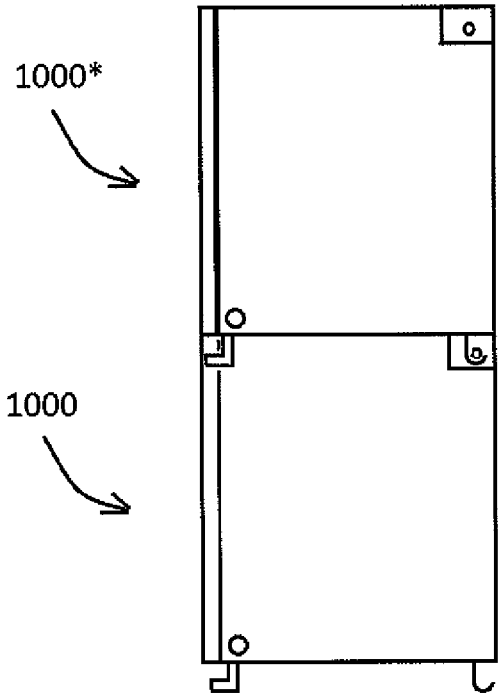

FIGS. 6A-6E illustrate an example of connecting a first dispensing unit 1000 to a second dispensing unit 1000* which may be identical to the first dispensing unit 1000. Referring to FIG. 6A, the second dispensing unit 1000* and the first dispensing unit 1000 may be provided. Initially, the door 500 of the first dispensing unit 1000 may be opened as shown in operation A and the second dispensing 1000* may be tipped back as shown in operation B to manipulate the second dispensing unit 1000* in a position so that the connecting member 187* may engage the connecting bar 122 of the unit 1000 shown as operation C in FIG. 6B. Once the connecting member 187* is engaged with the connecting bar 122 of the first dispensing unit 1000 as shown in FIG. 6C, the second dispensing unit 1000* may be tipped forward as shown in operation D of FIG. 6C so that the feet 180* of the second dispensing unit 1000* are inserted into the receiving notches 186 of the first dispensing unit 1000 as shown in FIG. 6D. In example embodiments, the door 500 may then be closed as shown in FIG. 6E so that when the door is closed, an upper surface of the door 550 lies over the feet 180* of the second dispensing unit 1000* thus capturing the second dispensing unit 1000* in place.

Example embodiments provide a dispensing unit 1000 with significant improvements over the conventional art. In particular, the sawtooth floor provides a surface which helps orient articles that may be stored in the dispensing unit 1000. For example, in the event the dispensing unit 1000 is used to dispense lottery cards, the sawtooth members help keep the lottery cards in a proper orientation. In addition, because the sides of the dispensing unit are configured to engage a holder, which in turn is configured to support a decorative article, the appearance of the dispensing unit 1000 is easily modifiable. Also, due to the presence of the feet and the receiving notches, several dispensing units 1000 may be easily connected to one another.

Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

I claim:

1. A dispensing unit comprising:

a body having a front wall, a first sidewall, a second sidewall, a floor, and a roof, wherein the body receives a second floor that is a sawtooth floor that has an upper surface with sawtooth members and is arranged on the floor and is rotatably connected to the body.

2. The dispensing unit according to claim 1, wherein the sawtooth members include a plurality of channels, the roof has a first plurality of rails, and the plurality of channels and the first plurality of rails are substantially aligned with one another.

3. The dispensing unit according to claim 2, further comprising:

at least one divider in at least one channel of the plurality of channels and at least one rail of the first plurality of rails.

4. The dispensing unit according to claim 1, wherein one of the body and the floor includes a protrusion and the other of the body and the floor includes an aperture into which the protrusion is inserted.

5. The dispensing unit according to claim 1, wherein the first sidewall includes at least a first aperture configured to receive a first protrusion of a first holder and the second sidewall includes at least a second aperture configured to receive a second protrusion of a second holder.

6. The dispensing unit according to claim 5, further comprising:

a first decorative member supported by the first holder; and a second decorative member supported by the second holder.

* * * * *